US006439024B1

(12) United States Patent
Staquet

(10) Patent No.: US 6,439,024 B1
(45) Date of Patent: Aug. 27, 2002

(54) TOOL AND METHOD FOR REORIENTING A HEM FLANGE

(75) Inventor: Edward T. Staquet, Broomall, PA (US)

(73) Assignee: Lord Corporation, Cary, NC (US)

( * ) Notice: Subject to any disclaimer, the term of this patent is extended or adjusted under 35 U.S.C. 154(b) by 0 days.

(21) Appl. No.: 09/905,288

(22) Filed: Jul. 13, 2001

(51) Int. Cl.[7] ..... B21D 5/16
(52) U.S. Cl. ..... 72/458; 72/479
(58) Field of Search ..... 72/458, 459, 479

(56) References Cited

U.S. PATENT DOCUMENTS

| | | | | |
|---|---|---|---|---|
| 2,547,391 A | * | 4/1951 | Hauschild | 29/275 |
| 2,637,292 A | * | 5/1953 | George, Jr. | 29/34 R |
| 2,810,420 A | * | 10/1957 | Gibson | 72/479 |
| 3,426,573 A | | 2/1969 | Wilson, Jr. | |
| 3,541,836 A | * | 11/1970 | Meis | 29/243.57 |
| 4,148,205 A | * | 4/1979 | Boysen | 72/176 |
| 4,176,541 A | | 12/1979 | Cooper | |
| 4,475,373 A | | 10/1984 | Ikenberry | |
| 4,926,536 A | | 5/1990 | Kohut | |
| 4,974,441 A | | 12/1990 | Keeney | |
| 5,052,209 A | | 10/1991 | DeMaagd | |
| 5,119,667 A | | 6/1992 | Hollis et al. | |
| 5,394,729 A | | 3/1995 | Eisenhower, Jr. | |
| 5,461,900 A | | 10/1995 | Gutierrez | |
| 5,730,021 A | | 3/1998 | Johnson | |
| 6,089,075 A | | 7/2000 | Bramblett | |
| 6,131,434 A | | 10/2000 | Schneider, Jr. | |

FOREIGN PATENT DOCUMENTS

| | | |
|---|---|---|
| DE | 24 55 545 | 5/1976 |

* cited by examiner

*Primary Examiner*—David Jones
(74) *Attorney, Agent, or Firm*—Michael M. Gnibus

(57) ABSTRACT

A tool for reorienting a flange member from a first angle of orientation to a second angle of orientation. The tool comprises a support member which includes a guide member; and the tool also comprises a shoe supported by the support member, the shoe comprising a leading portion and a first side portion adjacent the leading portion, the leading portion comprising a leading edge adapted to be located beneath the flange member and a reorienting surface for directing and displacing the flange to an orientation between the first and second angles of orientation, the side portion and guide member defining an orienting gap for orienting the moved flange to the desired second angle of orientation.

20 Claims, 6 Drawing Sheets

TOOL AND METHOD FOR REORIENTING A HEM FLANGE

FIELD OF THE INVENTION

The invention relates to a tool that simplifies opening the hem flange connection between a door skin and a door frame, and more specifically the invention relates to a hem flange reorienting tool and method whereby as the tool is moved along the length of the hem flange, the hem is separated from the frame, repositioned away from the frame and oriented at a desired separation angle relative to the frame.

BACKGROUND OF THE INVENTION

A vehicle door such as a door for a car or truck is generally comprised of a door frame and an outer door skin that is made integral with the frame at a hem flange defined by the perimeter edge of the skin. During the door assembly process, a suitable adhesive is placed proximate the peripheral door skin edge. The skin is then placed in the required position on the door frame and the desired hem flange is formed as the perimeter edge of the skin is bent around the frame and down onto the frame to produce the desired hem flange. The adhesive is sandwiched between the hem flange and the frame and forms the desired bond between the hem flange and the door frame. Finally, to ensure the requisite continuous, leakproof and tight bond is developed between the hem flange and door frame, suitable tools such as pliers or a hammer, are used to press, crimp or otherwise force the flange against the frame.

Over time, if the door becomes damaged or develops rust, the door panel skin frequently must be replaced. In order to replace the skin the hem flange is broken using a time consuming process. This prior art process is well known to those skilled in the art. Initially during the skin replacement process a grinding wheel is applied at the flange bend and the flange is ground to a minimum thickness at the bend. During this step in the replacement process, the grinding wheel is moved along the hem flange bend until it is possible to physically separate the main skin portion from the hem. The hem flange is then manually peeled away from the door frame using a chisel. Occasionally it may be necessary to use a hand held tool such as pliers to separate the hem and skin. Finally, the skin is removed from the door frame. It may be necessary to apply an air chisel or another suitable well known manually or pneumatically actuated tool between the skin and frame to break apart the members. Any remaining dried adhesive on the frame is then removed from the frame using a solvent, sandpaper or a suitable tool.

During this prior art removal process, the frame is frequently damaged by the removal tools. Because the new skin is sized to mate with a door frame of precise dimensions, in order to ensure the required bond between the skin and frame is formed, the frame must be reformed and returned to its initial precise dimensions and configuration. Therefore, after removing the hem flange from the door frame and before the new door skin is attached to the frame, it is often necessary for a technician to manually reshape and repair the door frame using a hammer and dolly in order to be able to effectively attach the new skin to the door frame. Repairing and reforming the door frame can be a time consuming and expensive process.

The foregoing illustrates limitations known to exist in present tools and methods for removing hem flanges joining door frames and door skins. Thus, it is apparent that it would be advantageous to provide an alternative directed to overcoming the limitations set forth above. Accordingly, a suitable alternative hem flange removal tool and method are provided including features more fully disclosed hereinafter.

SUMMARY OF THE INVENTION

In one aspect of the present invention this is accomplished by providing a tool for effectively removing the hem flange without deforming the door frame. As the tool of the present invention is moved along the hem length, the tool moves the flange from a first angle of orientation, repositions the hem away from the door frame and reorients the hem at an angle of approximately ninety degrees relative to the door frame. The hem flange removal tool of the present invention repositions and reorients the hem flange in one pass along the hem. In the first step, before the flange is moved from the first orientation angle, the tool may also break an adhesive bond between the flange and a frame. By the present invention, the time intensive steps associated with prior art hem flange removal methods including grinding and splitting the hem flange at the bend and reforming the frame are eliminated.

During separation of the skin and frame, a relatively sharp leading edge of the tool is driven below the flange and as the tool is moved along the flange between the flange and frame, the flange is urged away from the frame as the hem rides along a tapered portion of the removal tool. When the flange reaches the end of the tapered portion of the tool, it is located in an orientation gap. The orientation gap is oriented in the direction of travel of the tool and is defined between a planar longitudinally extending portion of the tool and an outer rigid skin. When the hem has passed through the gap, the hem is completely separated from the frame and is reoriented at an angle of orientation. The flange may be separated from the door frame by an angle of orientation substantially equal to ninety degrees. The significant separation angle allows a technician to easily access the area between the skin and frame to easily remove the door skin from the door frame.

The hem flange separation tool of the present invention may be attached to the end of a handle to be manually actuated or may be attached to a pneumatically actuated tool such as an air hammer and actuated by the pneumatic tool.

The foregoing and other aspects will become apparent from the following detailed description of the invention when considered in conjunction with the accompanying drawing figures.

DETAILED DESCRIPTION OF THE PREFERRED EMBODIMENT

Figure 1:
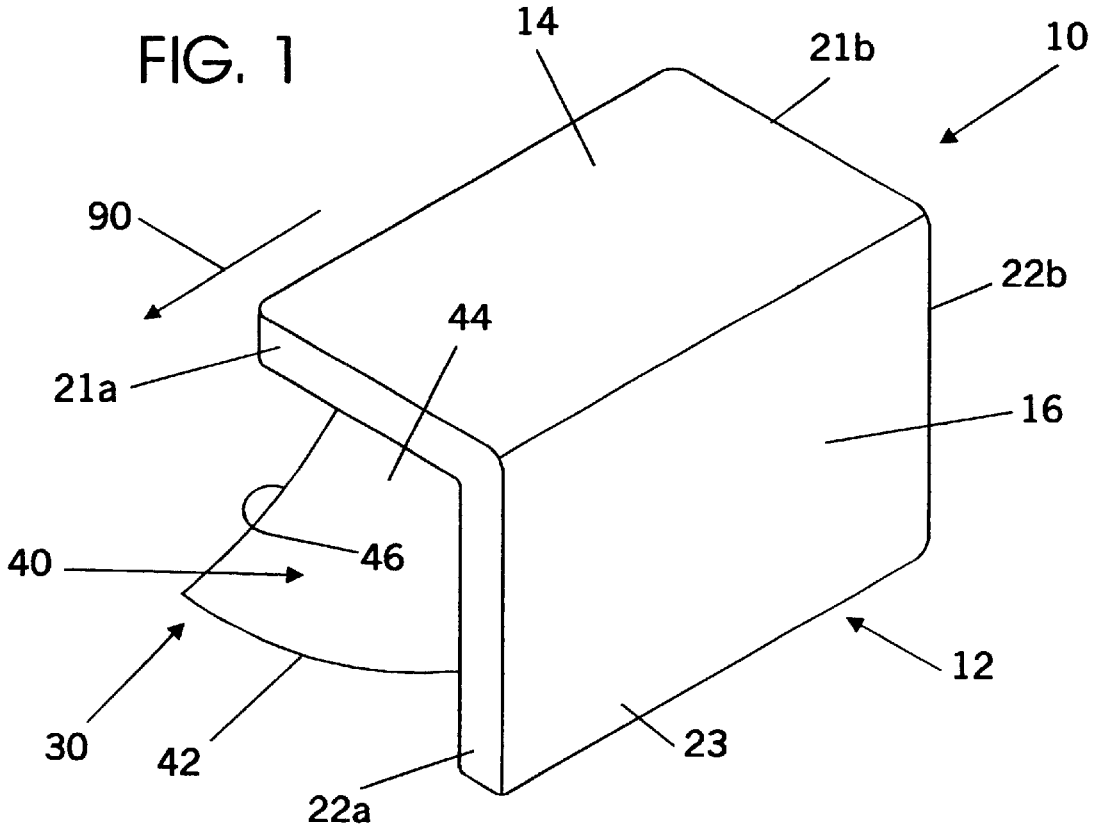
FIG. 1 is an isometric view illustrating the front, top and right side views of the hem flange removal tool of the present invention.
Figure 2:
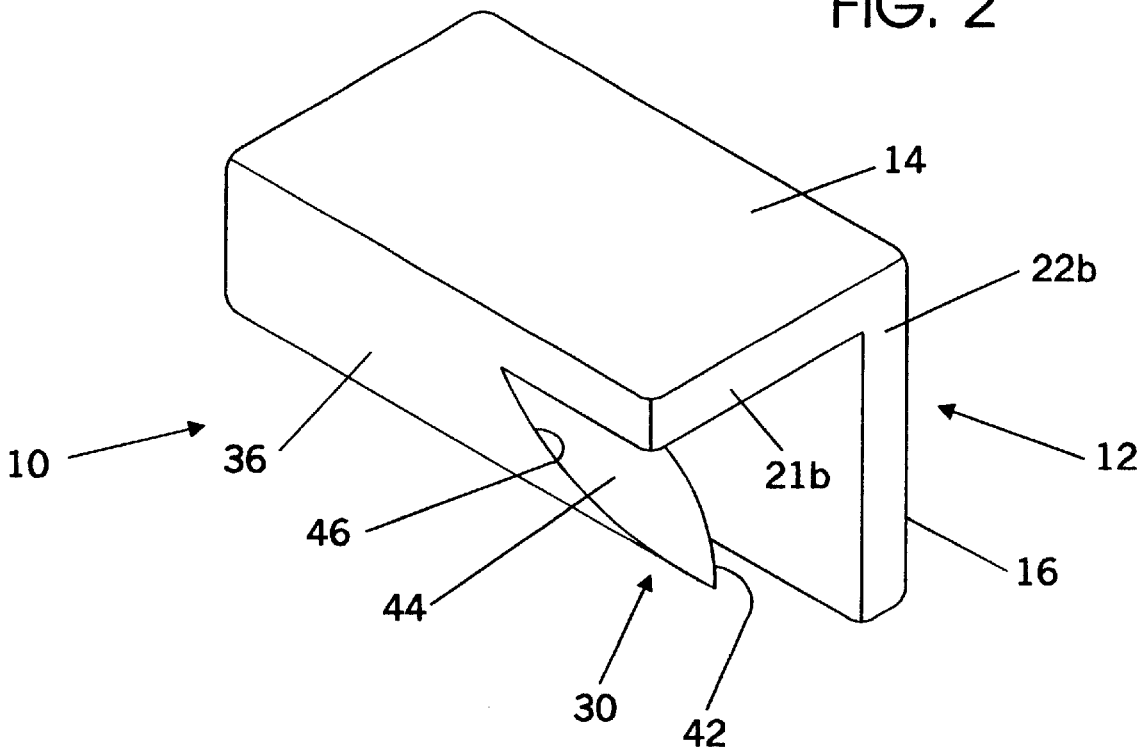
FIG. 2 is an isometric view of the hem flange removal tool of FIG. 1 illustrating the front, top and left side views of the tool.
Figure 3:
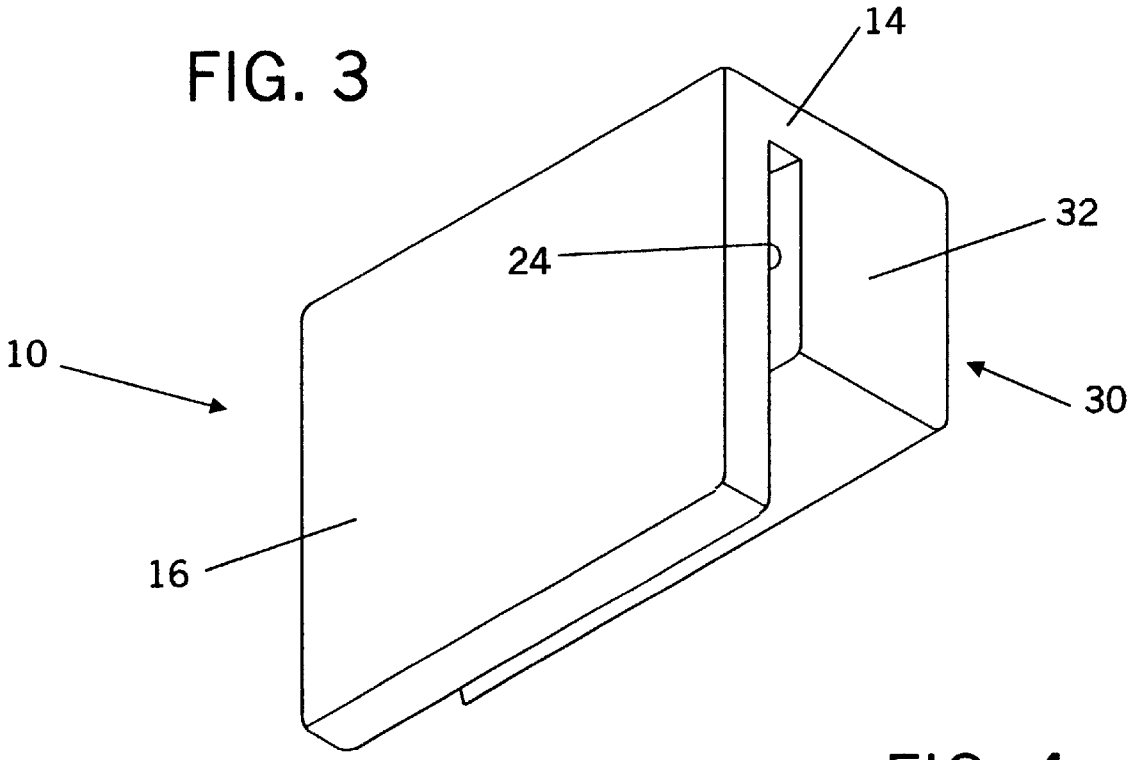
FIG. 3 is an isometric view of the hem flange removal tool of FIG. 1 illustrating the rear, bottom and right side views of the tool.
Figure 4:
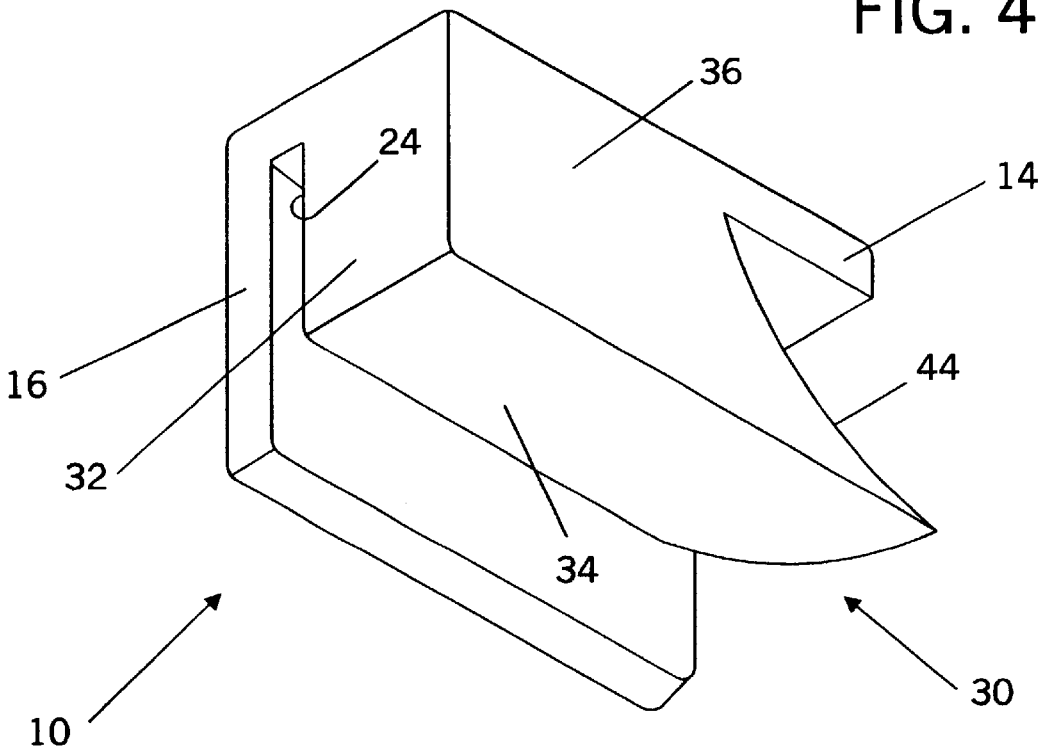
FIG. 4 is an isometric view of the hem flange removal tool of FIG. 1 illustrating the rear, bottom and left side views of the tool.

Now turning to the drawing figures wherein like parts are referred to by the same numbers in the several views, FIGS. 1–6 illustrate a preferred embodiment of the hem flange removal tool 10 of the present invention. The hem flange removal tool of the present invention generally: (a) lifts flange 70 from a first angle of orientation; (b) lifts the free edge 71 of flange 70 and repositions the flange 70 away from frame 74 and finally (c) orients the flange 70 at an angle 80, approximately equal to ninety degrees relative to the edge of frame 74. See FIGS. 10A and 10B. In step (a) as the tool is displaced, the tool may also break a bond between the flange and frame formed by adhesive 76 between the hem flange door skin 72 and door frame 74.

Figure 5:
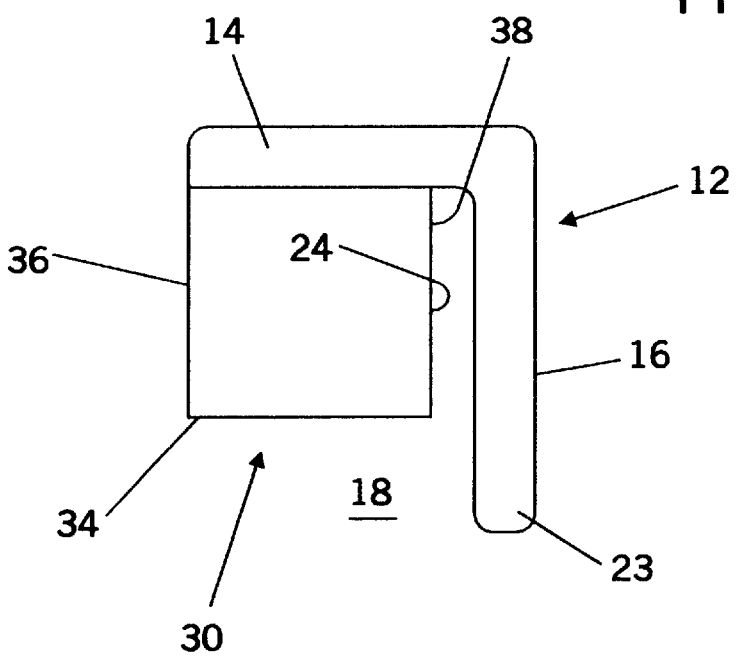
FIG. 5 is a front view of the tool of FIG. 1.
Figure 6:
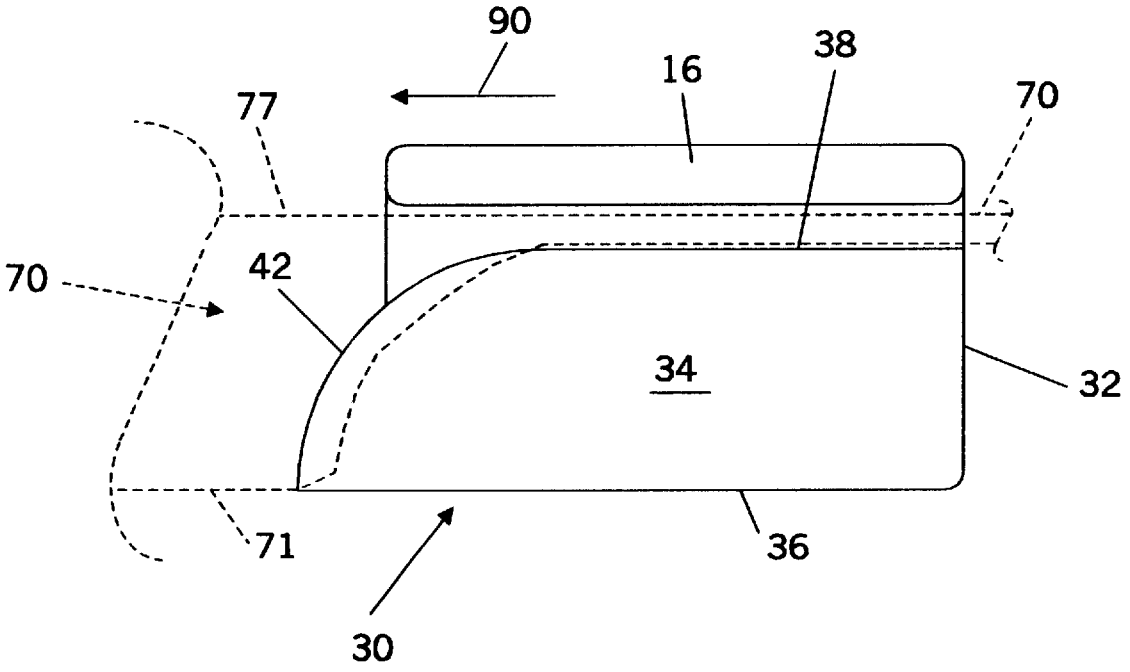
FIG. 6 is a bottom view of the hem flange removal tool of FIG. 1.

The hem flange tool 10 is unitary and is preferably made from a cast metal which most preferably is steel. The tool comprises an L-shaped guide support 12 that further comprises an upper support member 14 and downwardly extending guide member 16. As shown in FIG. 5, the support member 14 and guide member 16 define a tool interior 18. As shown in FIGS. 1 and 6 during use, the tool is displaced along flange 70 in direction 90, and the members 14 and 16 each have respective leading and trailing surfaces corresponding with the direction of travel and the surfaces are identified as 21*a,* 21*b* for member 14 and 22*a,* 22*b* for member 16.

Figure 8:
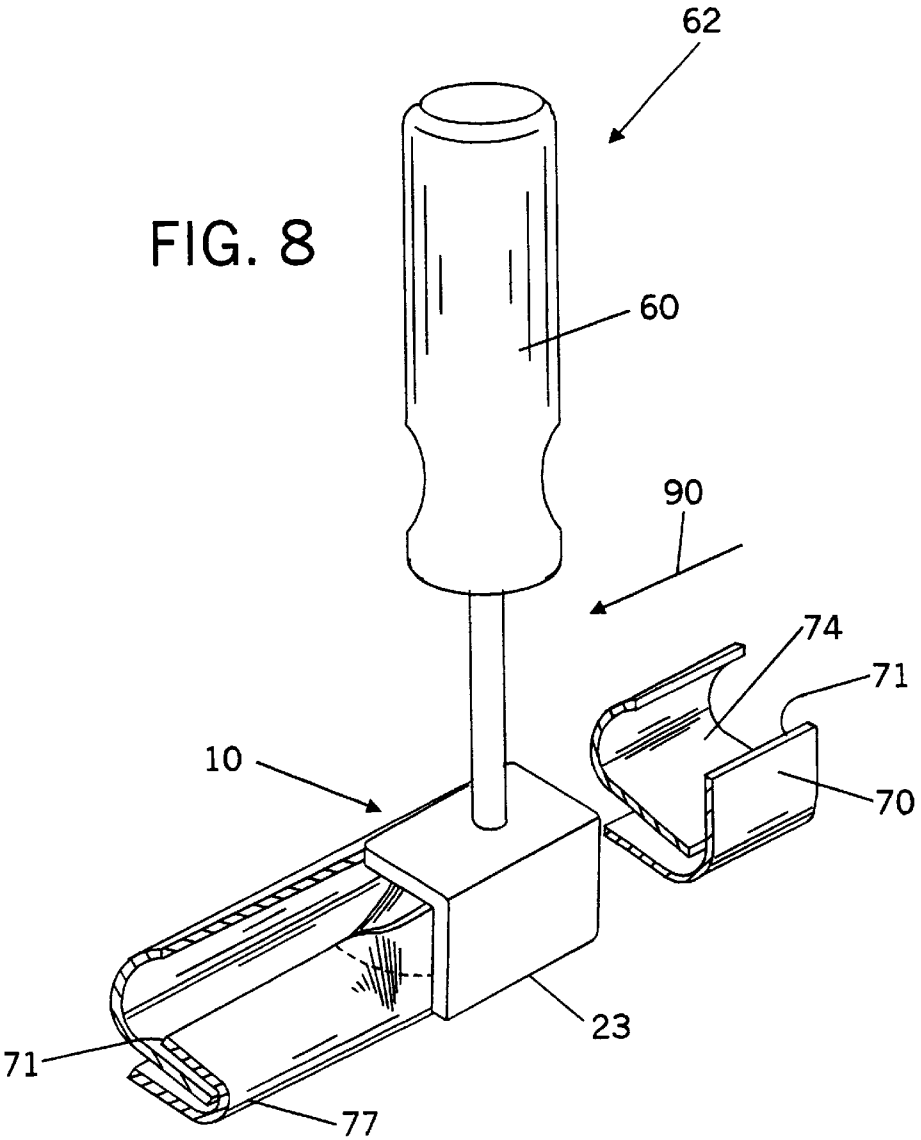
FIG. 8 is a schematic representation of a manually actuated hem flange removal tool as it is moved along the hem flange.
Figure 9:
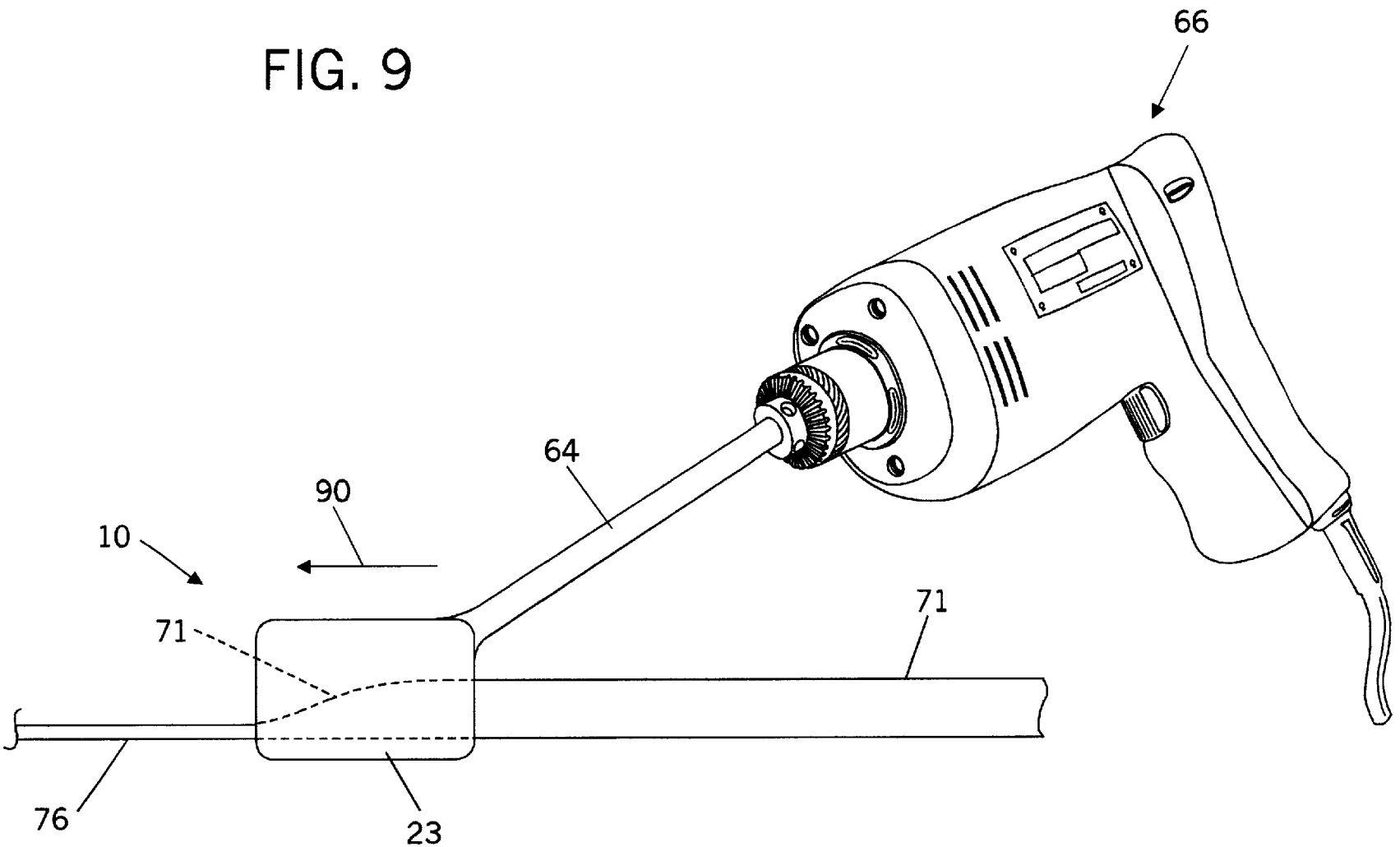
FIG. 9 is a schematic representation of a pneumatically actuated hem flange removal tool as it is moved along the hem flange.

The unitary hem flange removal tool 10 also comprises shoe member 30 that is supported by member 14 and extends into interior 18. The shoe is spaced away from guide member 16 by an orienting gap or channel 24. The tool comprises rear surface 32, bottom surface 34 exterior longitudinally extending surface 36 and interior longitudinally extending surface 38. The surfaces 32, 34, 36 and 38 are substantially planar. As shown most clearly in FIG. 5, the interior longitudinal surface 38 is substantially parallel to guide member 16 and in this way the surface 38 and member 16 define an orienting gap 24 that has a substantially constant lateral dimension. The orienting gap is of sufficient magnitude to allow the hem flange 70 to pass uninterrupted through the tool as the flange is reoriented to the position shown in FIG. 10B. By reorienting the flange at an angle of approximately 90° relative to the door frame, the skin can be easily removed from the frame and discarded. The guide member 16 terminates at a tail portion 23 below the plane defined by bottom surface 34. The guide member tail portion 23 extends below the flange bend 77 as shown in FIGS. 8 and 9 and overlaps the flange to ensure the shoe is maintained within the flange and also decrease the chance the tool will lift or jump out from within the flange as the tool is displaced along the flange length. Therefore, the tool is more stable than if the guide 16 terminated aligned or substantially aligned with the bottom surface 34.

The shoe further comprises a contoured leading lateral surface 40. The leading lateral surface is defined by a relatively sharp leading edge 42 and an inwardly tapered repositioning surface 44 behind the leading edge. As shown in FIG. 6, the leading edge 42 has an arcuate configuration and extends about ninety degrees (90°) between longitudinal surfaces 36 and 38. A portion of the leading edge extends outwardly beyond the leading faces of members 14 and 16. The leading edge is relatively sharp and in this way the edge may be effectively inserted beneath the flange between the flange 70 and door frame 74 as will be described in greater detail hereinafter. Also, the sharp leading edge scrapes a significant portion of any adhesive off of the frame 74 making cleaning the frame and preparing the frame for repair a simpler process.

The inwardly tapered repositioning surface 44 joins longitudinal sides 36 and 38. The surface 44 is bound longitudinally at surface 36 by first edge 46 and at surface 38 by edge 48 and both edges are oriented substantially in the direction of travel of tool 10. The inwardly tapered "scoop like" configuration of surface 44 spans an angle of about ninety (90°) degrees between sides 36 and 38 and at edge 48 the surface is directed substantially perpendicular to the direction of tool travel 90. As a result, as the tool is directed along hem 70, the portion of surface 44 at edge 46 serves to lift the flange from the frame, and then as the tool is inserted further into the flange and the flange travels along the surface 44, the reorienting surface 44 contour redirects and further displaces the flange 70 away from the frame until the flange is inserted in channel or orienting gap 24.

The tool 10 may be made integral with handle 60 of manually actuated tool 62 shown in FIG. 8. Alternatively, as shown in FIG. 9, the tool 10 may be made integral with shaft member 64 which in turn is actuated by a pneumatically actuated device 66 such as an air hammer for example. As shown in FIG. 9, the shaft is oriented at an angle relative to the direction of displacement 90 for the tool 10.

Operation of tool 10 will now be described.

Figure 7:
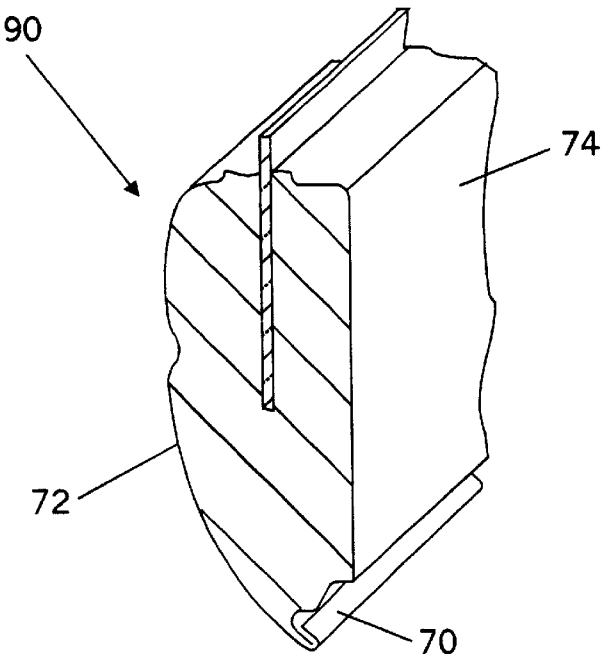
FIG. 7 is an isometric schematic partial representation of the attached door frame and door skin.

The tools 62 and 66 serve as the means for moving the tool through the hem flange 70. Operation of tool 10 is substantially the same for the manually and pneumatically actuated tools 62 and 66 and therefore as the description of the operation of the invention proceeds, the operation of tool will be described without specific reference to the means for moving the tool through the hem flange. either tool 62 or tool 66. When the skin of door 90 has been damaged or it is for other reasons necessary to remove the skin from the door frame 74, the flange must be moved away from the frame in order to separate the skin from the frame. If the flange is bonded to the frame the bond between the hem flange and door frame must be broken before the hem flange is reoriented away from the door frame 74. A schematic representation of a portion of a door 90 is shown in FIG. 7. For purposes of describing the operation of the preferred embodiment of the invention it is assumed that the flange and frame are bonded by adhesive 76. The flange and frame may alternatively be tack welded.

Figure 10B:
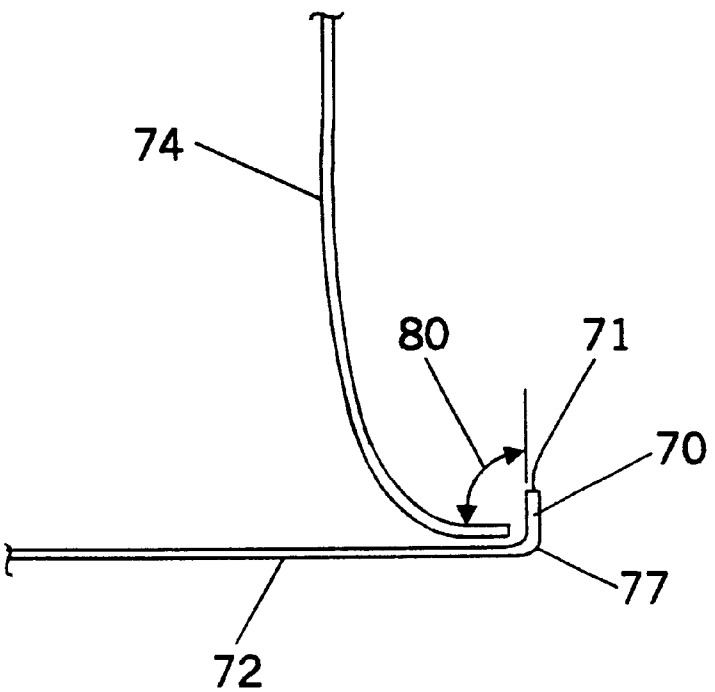
FIGS. 10A and 10B represent the relative positions between the door frame and hem flange before and after the application of the hem flange removal to the hem.
Figure 10A:
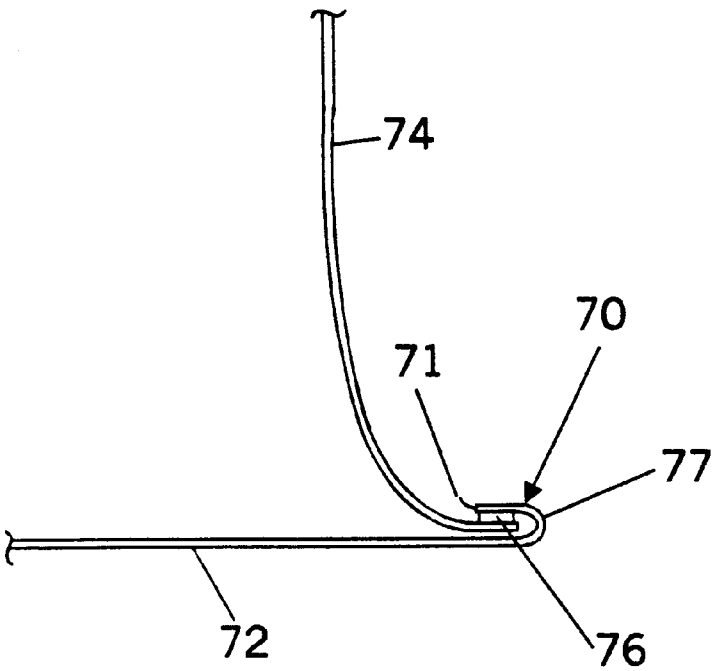

The tool is oriented so that the guide 14 is located against the closed side of the flange and against bend 77. As shown in FIGS. 8 and 9, the tail portion 23 extends below bend 77 to ensure the shoe remains in the desired location between flange 70 and frame 74 as the tool is moved and the flange is reoriented. At this time the flange in bonded to door frame 74 by adhesive 76 as shown in FIG. 10A. The leading shoe edge 42 is inserted under the flange 70 between the flange and door frame. The motive force required to displace tool 10 in direction 90 between the flange and door frame is applied by pneumatic tool 66 or manually actuated tool 62.

As previously mentioned, the tool reorients the flange in three operations or steps as it is moved along the hem. First, it lifts the flange (if bonded, the bond is broken between the hem and door frame before the lifting step is executed). Second, shoe repositions the flange away from the door frame. Finally, the tool reorients the flange so that the flange does not interfere with the skin removal from the frame. The bond is broken as the leading edge 42 is pierces and is driven through the adhesive layer 76. Then, as shown in greatest detail in FIG. 8, the free edge 71 of flange 70 is urged outwardly as the reorienting surface 44 passes under the flange. When the free edge of the flange travels downstream to edge 48, the flange is substantially oriented at the angle shown in FIGS. 8 and 9. The flange is then passed through channel 24 whereby the hem is reoriented to the desired final angle of orientation. The flange is displaced from a first angle of orientation shown in FIG. 10A to a final angle of orientation shown in FIG. 10B. The difference between the first and second angles of orientation is approximately ninety degrees. It should be understood that although an angle of ninety degrees (90°) is shown and described, the difference between angles of orientation for the resultant reoriented flange may be any suitable relative angle between. As shown in FIG. 10B the door frame and flange are separated by about ninety degrees. It has been determined by the inventor that an angular difference of ninety degrees allows for the most effective, uninhibited separation of the skin and door frame.

While I have illustrated and described a preferred embodiment of my invention, it is understood that this is capable of modification and therefore I do not wish to be limited to the precise details set forth, but desire to avail myself of such changes and alterations as fall within the purview of the following claims.

I claim:

1. A tool for reorienting a flange member from a first angle of orientation to a second angle of orientation, the tool comprising:

A) a support member, the support member further comprising a guide member; and

B) a shoe supported by the support member, the shoe comprising a leading portion and a first side portion adjacent the leading portion. the leading portion comprising a leading edge adapted to be located beneath the flange member and a reorienting surface for directing and displacing the flange to an orientation between the first and second angles of orientation, wherein the reorienting surface spans an angle of about ninety degrees, the side portion and guide member defining an orienting gap for orienting the moved flange to the desired second angle of orientation.

2. The tool as claimed in claim 1 wherein the shoe comprises a bottom surface that defines a plane, the guide member comprising a tail, the tail extending below the plane of the bottom surface.

3. The tool as claimed in claim 1 wherein the leading edge is arcuate.

4. The tool as claimed in claim 1 wherein the reorienting surface is inwardly tapered.

5. The tool as claimed in claim 1 wherein the support member comprises a shoe support member, the shoe being supported by the shoe support member.

6. The tool as claimed in claim 5 wherein the support member is unitary, the shoe support member and guide member defining a tool interior, the shoe being located substantially within the defined interior.

7. The tool as claimed in claim 5 wherein the shoe support member has a leading surface, and wherein a portion of the leading edge extends outwardly beyond the support member leading surface.

8. The tool as claimed in claim 5 wherein the shoe support member has a trailing surface, the shoe further comprising a rear surface, the rear surface and trailing surface being coplanar.

9. The tool as claimed in claim 1 wherein the shoe further comprises a bottom surface and a second side portion, the leading portion joining the first and second side portions.

10. The tool as claimed in claim 9 wherein the bottom surface, first side portion and second side portion are planar.

11. The tool as claimed in claim 1 wherein the tool is unitary.

12. The tool as claimed in claim 1 wherein the difference between the first and second angles of orientation is about ninety degrees.

13. A combination comprising:

A) a handle; and

B) a tool for reorienting a flange member from a first angle of orientation to a second angle of orientation, the tool comprising: a support member, the support member further comprising a guide member; and a shoe supported by the support member, the shoe comprising a leading portion and a first side portion adjacent the leading portion, the leading portion comprising a leading edge adapted to be located beneath the flange member and a reorienting surface for directing and displacing the flange to an orientation between the first and second angles of orientation, the reorienting surface spanning an angle of about ninety degrees, the side portion and guide member defining an orienting gap for orienting the moved flange to the desired second angle of orientation.

14. The combination as claimed in claim 13 wherein the combination is unitary.

15. A combination comprising:

A) a pneumatically actuated tool; and

B) a tool for reorienting a flange member from a first angle of orientation to a second angle of orientation, the tool comprising: a support member, the support member further comprising a guide member; and a shoe supported by the support member, the shoe comprising a leading portion and a first side portion adjacent the leading portion, the leading portion comprising a leading edge adapted to be located beneath the flange member and a reorienting surface for directing and displacing the flange to an orientation between the first and second angles of orientation, the reorienting surface spanning an angle of about ninety degrees, the side portion and guide member defining an orienting gap for orienting the moved flange to the desired second angle of orientation.

16. The combination as claimed in claim 15, wherein the tool is made integral with one end of a shaft, the opposite shaft end being coupled to the pneumatic tool.

17. Using a tool comprising a shoe with a leading portion having a leading edge and a reorienting surface that spans about ninety degrees and a guide member separated from said shoe by a channel, a method for reorienting a flange member using the tool from a first angle of orientation to a second angle of orientation, the method comprising the steps of: a) lifting the flange from the first angle of orientation; b) reorienting the flange to a position between the first angle of orientation and the second angle of orientation; and c) moving the flange through the channel thereby orienting the flange at the second angle of orientation.

18. The method as claimed in claim 17 wherein the flange is bonded to a frame, step a) comprising the additional step of breaking the bond.

19. The method as claimed in claim 17 wherein the flange is a hem flange in a vehicle door.

20. The method as claimed in claim 17 wherein the flange is reoriented by an angle of about ninety degrees.

* * * * *